US006564967B1

(12) United States Patent
Stringfield et al.

(10) Patent No.: US 6,564,967 B1
(45) Date of Patent: May 20, 2003

(54) CHILD RESISTANT TABLET DISPENSER

(75) Inventors: Don Stringfield, Macon, GA (US); John F. Salazar, Louisville, KY (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/896,661

(22) Filed: Jun. 29, 2001

(51) Int. Cl.[7] ..... G07F 11/16
(52) U.S. Cl. ..... 221/229
(58) Field of Search ..... 221/152, 229, 221/232

(56) References Cited

U.S. PATENT DOCUMENTS

| | | | | | |
|---|---|---|---|---|---|
| 462,220 | A | * | 10/1891 | Michl | 453/48 |
| 977,583 | A | | 12/1910 | Beardsley | |
| 1,814,929 | A | * | 7/1931 | Hrissulakis | 221/148 |
| 1,876,680 | A | | 9/1932 | Holtzman | |
| 2,255,450 | A | * | 9/1941 | Mutchler | 221/30 |
| 2,620,061 | A | | 12/1952 | Uxa | |
| 2,853,206 | A | | 9/1958 | Uxa | |
| 3,410,455 | A | | 11/1968 | Haas | |
| 3,511,409 | A | | 5/1970 | Huck | |
| 3,515,111 | A | | 6/1970 | Auge | |
| 3,565,284 | A | | 2/1971 | Hinterreiter | |
| 3,844,445 | A | | 10/1974 | Haas | |
| 3,845,882 | A | | 11/1974 | Hass | |
| 3,863,803 | A | | 2/1975 | Valcic | |
| 3,898,031 | A | | 8/1975 | Rusakowicz | |
| 3,942,683 | A | | 3/1976 | Haas | |
| 4,171,753 | A | | 10/1979 | Vreede | |
| 4,295,579 | A | | 10/1981 | Haas | |
| 4,311,251 | A | | 1/1982 | Sternberg | |
| 4,485,938 | A | | 12/1984 | Williams | |
| 4,784,288 | A | * | 11/1988 | Jennings | 221/4 |
| 4,966,305 | A | | 10/1990 | Hinterreiter | |
| 4,986,442 | A | | 1/1991 | Hinterreiter | |
| 5,002,482 | A | | 3/1991 | Fairbanks et al. | |
| 5,048,720 | A | | 9/1991 | Hoke | |
| 5,071,033 | A | | 12/1991 | Siwek | |
| 5,080,258 | A | | 1/1992 | Hinterreiter | |
| 5,108,006 | A | * | 4/1992 | Tieke et al. | 221/152 |
| 5,178,298 | A | | 1/1993 | Allina | |
| 5,217,364 | A | | 6/1993 | Frigiere | |
| 5,353,956 | A | | 10/1994 | Wilson | |
| 5,487,657 | A | | 1/1996 | Fairbanks et al. | |
| 5,566,857 | A | | 10/1996 | Rothman | |
| 5,657,901 | A | * | 8/1997 | Farside | 221/152 |
| 5,785,206 | A | | 7/1998 | Chan | |

FOREIGN PATENT DOCUMENTS

| | | | | | |
|---|---|---|---|---|---|
| AU | WO 0214181 | A1 | * | 2/2002 | B65D/83/04 |
| DE | 4201995 | A1 | * | 7/1993 | B65D/83/06 |

* cited by examiner

*Primary Examiner*—Donald P. Walsh
*Assistant Examiner*—Joseph Rodriguez
(74) *Attorney, Agent, or Firm*—John F. Salazar; Charles G. Lamb; Middleton Reutlinger

(57) ABSTRACT

A child resistant tablet dispenser is disclosed wherein the dispenser is comprised of a body portion and a release mechanism. The body portion may be hollow and cylindrical and contain therein a plurality of tablets in a tablet magazine. The tablets may be individually dispensed through the release mechanism which has a child resistant dispenser requiring multiple actions before an individual tablet may be dispensed. The multiple actions required on the release mechanism may be in two different planes thereby requiring movement in a horizontal plane and movement in a vertical plane in order to release a slide actuator and then depress a release button for opening of the release mechanism lid. Upon opening of the lid, an individual tablet is forced outward from the cylinder of the body portion and dispensed.

19 Claims, 2 Drawing Sheets

CHILD RESISTANT TABLET DISPENSER

BACKGROUND OF THE INVENTION

1. Field of the Invention

The present invention elates to a child resistant tablet dispenser wherein tablets may be individually dispensed after activation of a slide actuator and press button whereby the activation requires a two-step child resistant process thereby resisting child tampering and opening of the package.

2. Discussion of the Prior Art

Prior art child resistant tablet dispensers typically are comprised of flat horizontal based dispensers wherein child-proof packaging or other material is required to be removed from the outer packaging prior to dispensing of the tablets or pills. Such container packaging is shown in U.S. Pat. No. 5,575,399 wherein a flat packaging container is shown which requires compression of child resistant tabs in order to separate the upper and lower horizontal package members.

Other tamper proof pill dispensing apparatus are known such as disclosed in U.S. Pat. No. 4,485,938 wherein individual pills are dispensed through a discharge outlet. Safety latches are also provided in diametrically opposite positions in order to prevent activation by children.

Other tablet dispensing receptacles are known such as that disclosed in U.S. Pat. No. 3,942,683 wherein a cylindrical housing is capped with a spring biased cover which is simply rotatable about a pivot point thereby providing access to the contents of the package.

However, none of the prior art package dispensers provide a child resistant tablet dispenser wherein the tablets are retained within a cylindrical body in magazine type formation and wherein the dispenser has a child resistant release mechanism for gaining access to the contents of the package.

SUMMARY OF THE INVENTION

The object of the present invention is therefore to provide a child resistant tablet dispenser wherein the dispenser has a release mechanism which may not be activated by a child or which is at least child resistant.

A further object of the present invention is to provide a tablet dispenser having a release mechanism wherein the release mechanism is child resistant and which contains a cylindrical body wherein a plurality of tablets may be contained.

An additional object of the present invention is to provide a child resistant tablet dispenser wherein the release mechanism is readily activatable preferably by an adult and wherein the release mechanism releases a hinged lid while also individually dispensing the tablets contained within a tablet magazine.

An additional object of the present invention is to provide a child resistant tablet dispenser wherein a tablet magazine is spring biased so that, after individual depletion of the tablets from the top end, each of the tablets may be singularly indexed for release upon the next activation of the release mechanism.

It is an additional object of the present invention to provide a child resistant tablet dispenser wherein the release mechanism, which preferably prevents a child from activating the mechanism, incorporates use of a slide actuator which must be used in conjunction with a release button, both actions requiring movement and perpendicular planes.

A further object of the present invention is to provide a tablet dispenser wherein the release mechanism is child resistant and wherein a hinged lid is biased such that upon activation and opening of the lid, individual tablets are dispensed from a cylindrical dispenser body.

The above and other objects are accomplished in accordance with the present invention by providing a child resistant tablet dispenser having a release button and slide actuator as a release mechanism, the release button requiring movement in the vertical plane and the slide actuator requiring movement in the horizontal plane in order for the hinged lid to be opened for releasing individual tablets contained within the package body.

All of the above outlined objectives are to be understood as exemplary only and many more objectives of the invention may be gleaned from the disclosure herein. Therefore, no limiting interpretation of the objectives noted are to be understood without further reading of the entire specification and drawings included herewith.

DETAILED DESCRIPTION OF THE PREFERRED EMBODIMENT

Figure 1:
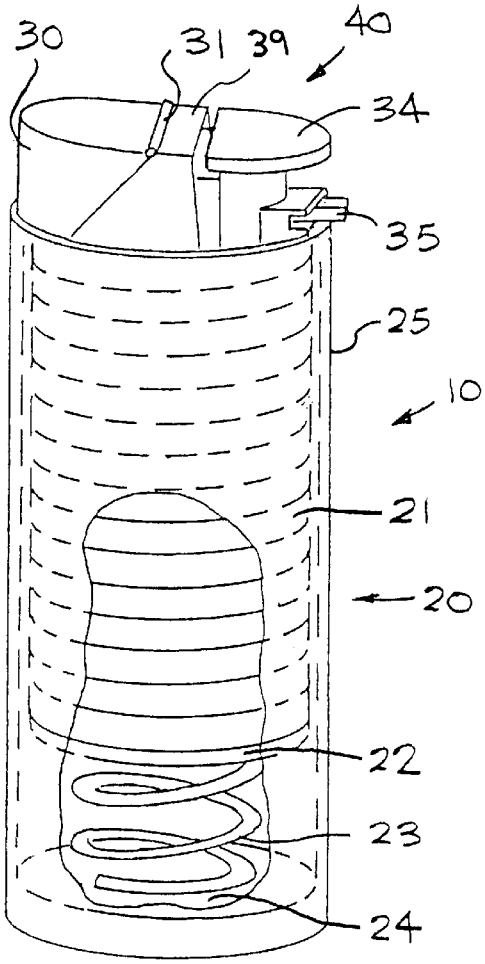
FIG. 1 is a perspective cutaway view of the child resistant tablet dispenser of the present invention.

The child resistant tablet dispenser 10 of the present invention is depicted in FIG. 1 with a partial cutaway view shown therein. The dispenser 10 is comprised of a body portion 20 and a release and dispensing mechanism 40 which is attached to the top open end of the body portion. The body portion 20 is constructed of plastic or other similar material and may be cylindrical in design in order to retain therein a plurality of tablets to be dispensed. At the top open end of the body portion 20 is the release mechanism 40 which provides a child resistant dispensing mechanism wherein action is required along both the horizontal plane and the vertical plane. This action is required in the present embodiment by movement of slide actuator 35 in the left or right direction as well as depression of the release button 34 in order for the lid 30 to rotate about hinge 31 thereby releasing a tablet from the open end of the release mechanism 40. Once dispensed, the lid is re-closed thereby locking the release and dispensing mechanism 40 and requiring re-actuation of the child resistant feature.

Figure 2:
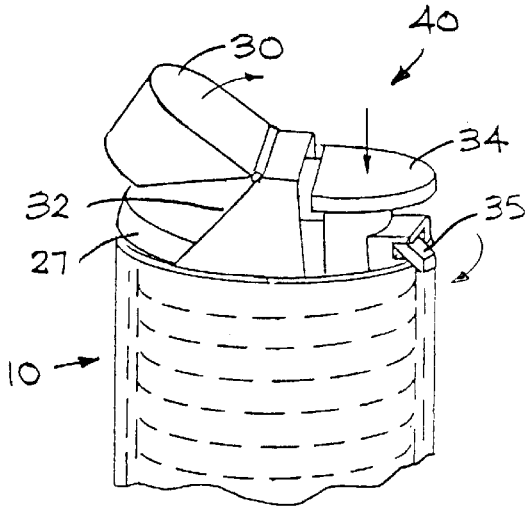
FIG. 2 is a close-up perspective view of the release mechanism for the tablet dispenser shown in FIG. 1.
Figure 3:
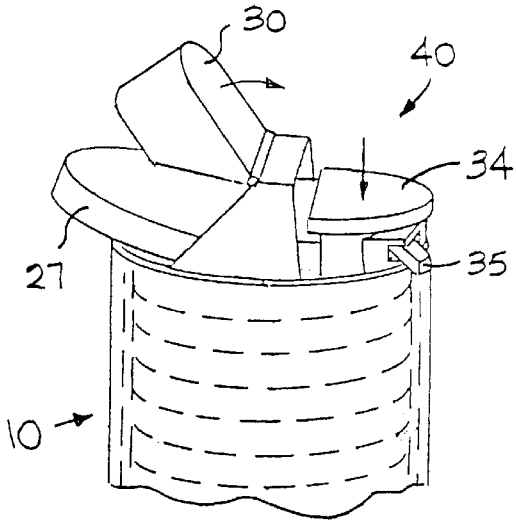
FIG. 3 is a close-up perspective view of the release mechanism for the child resistant tablet dispenser shown in FIG. 1 wherein the release mechanism is activated.

The body portion 20, as indicated above, may be constructed of plastic or other similar materials such as aluminum, tin, metal alloy or other similar component. The body portion 20 may be designed as a hollow cylinder or ovoid 25 which retains therein a tablet magazine 21 for individual dispensing of the top most tablet 27, as is shown in FIG. 2 and FIG. 3. The tablet magazine 21 rest upon a platform 22 in the interior of the body portion 20 and within the cylinder 25, the cylinder 25 matching the size and geometry of the tablet magazine 21. The platform 22 on which the tablet magazine 21 rests is spring biased by spring 23 which is attached to the base 24 of the cylinder. The spring forces the tablet magazine in the upward direction thereby allowing the individual dispensing of tablets within the tablet magazine 21. As each individual tablet 27 is dispensed from the top most end of the tablet magazine 21, the spring 23 forces platform 22 upward thereby maintaining upward pressure on the tablet magazine and maintaining direct contact of the top most tablet 27 with release mechanism 40.

The cylinder 25 of the body portion 20 may also have on the interior portion thereof a plurality of channels or ridges for the platform 22 to ride vertically thereon in order that the platform 22 may move in the vertical direction in either the upward or downward direction in ready fashion. Further, multiple springs may be provided to maintain the efficacy of the bias against platform 22 when the tablet magazine is in the near empty condition.

As is depicted in the figures, the child resistant tablet dispenser 10 of the present invention additionally has a release mechanism 40 mounted on the top most end of the body portion 20. The release mechanism 40 is designed to provide a child resistant dispensing feature wherein multiple actions are required in order to prevent dispensing of the tablet from the tablet magazine by a child. The release mechanism 40 of the present invention as depicted in the figures maybe comprised of a release button 34 which requires depression thereof and which must be completed after movement along a horizontal plane of the slide actuator 35. Slide actuator 35 therefore prevents downward movement of the release button 34 unless the slide actuator 35 is placed in the release open or unlocked position, as is depicted in FIG. 2 and FIG. 3. When the slide actuator is in the closed or locked position as shown in FIG. 1, the release button may not be depressed or the lid 30 may not be raised.

As shown in FIG. 2 and in FIG. 3, the slide actuator has been rotated in a counter-clockwise fashion in order to allow the button 34 to be depressed with a downward force. Once the button 34 is depressed, the lid 30 opens and rotates about hinge 31 allowing the top most tablet 27 to be dispensed through opening 32 of the release mechanism. Continued downward force on the release button 34 causes the top tablet 27 to be slide forward and out of opening 32 thereby allowing a user to pull the tablet 27 from release mechanism 40. Thus, as can be seen, the child resistant tablet dispenser 10 of the present invention requires that a multiple number of actions are required in order to dispense the tablet from the tablet magazine 21 and through the release mechanism 40.

The present invention is utilized to dispense individual tablets from tablet magazine 21. These individual tablets may be comprised of pharmaceutical material, ver the counter medications, tobacco products or other material in which restrictions must be placed upon child access. Thus, it is desirable to prevent easy access to the contents of the dispenser 10 of the present invention and a child resistant dispenser is therefore desired. The overall size of the dispenser 10 of the present invention may be such that is readily hand held and actuated by multiple movement of the users thumb.

Figure 4:
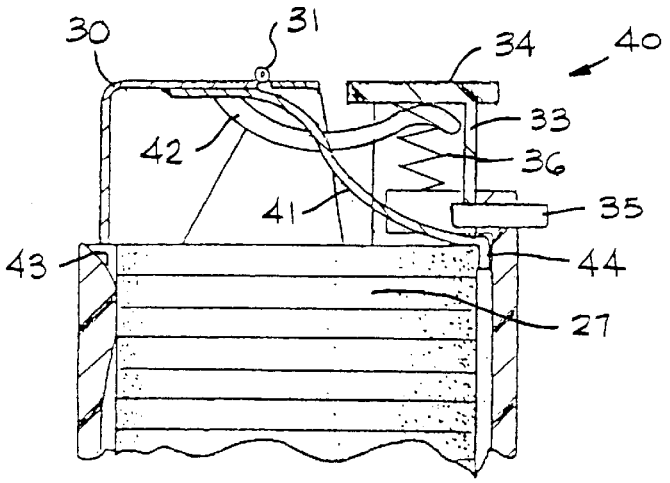
FIG. 4 is a side-sectional view of the release mechanism and tablet dispenser shown in FIG. 1.

Returning to the figures, as shown in FIG. 4, the release mechanism 40 is depicted therein. The release mechanism 40 is comprised of the release button 34 and the button support bar 33 which extends downward therefrom. The button support bar 33 contacts the upper surface of the slide actuator 35 when the slide actuator is in the closed or locked position as depicted in FIG. 4. Upward pressure is maintained against the release button 34 by spring 36 which resists downward pressure movement of the release button 34 and which therefore will require, depending upon the strength of spring 36, significant agility and downward force in order to open the release mechanism 40.

The release mechanism 40 further is comprised of lid 30 which rotates about hinge member 31 once the release button 34 is depressed downward after slide actuator is opened. Lid 30 is hingedly connected to lid mount 39 which, in this embodiment, is fixed between the lid and the release button 34. As shown in the figures, the inner portion of the lid 30 has welded or integrally formed therein a retaining arm 42 which is a rigid structure allowing translation of the downward force placed upon the release button 34 into upward rotational force placed upon the interior upper surface of the lid 30. Thus, downward force of release button 34 will cause the lid 30 to rotate about hinge 31. The retaining arm 42 is also sufficiently rigid enough such that when the release button 34 is in the locked position as is depicted in FIG. 4, upward force on the lid 30 will not cause the lid to open and the retaining arm 42 will maintain the lid 30 in the closed and locked position. However, once the slide actuator 35 is in the open unlock position, the release button 34 may be depressed and retaining arm 42 causes lid 30 to rotate about hinge 31 and lid mount 39.

Figure 5:
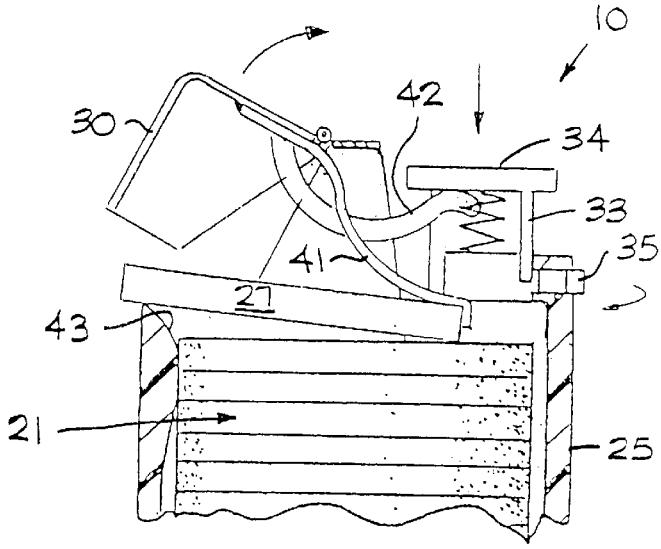
FIG. 5 is a side-sectional view of the release mechanism and tablet dispenser of FIG. 1 dispensing a tablet; and, FIG. 6 is a side-sectional view of an alternative embodiment for the child resistant tablet dispenser of the present invention.
Figure 6:
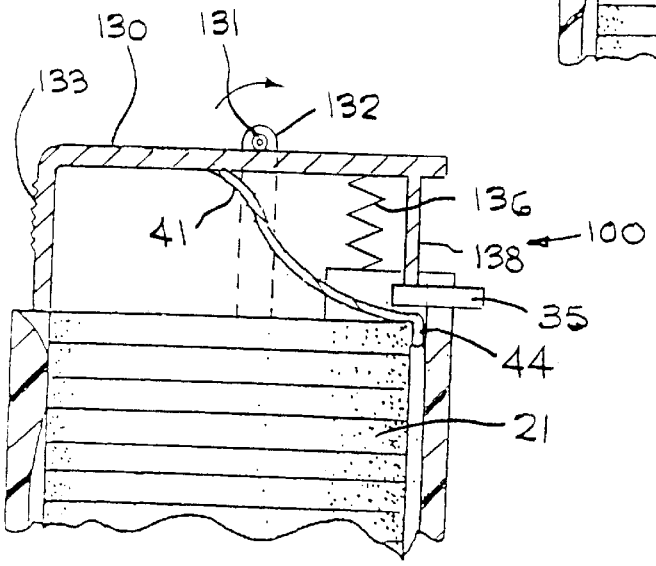

Also shown in FIG. 4 and FIG. 5 is the slide arm 41 which is an additional semi-rigid or rigid structure which allows upward movement of the lid 30 to be translated to sliding movement in the horizontal plane by the slide hook 44 such that a right to left motion is completed and the top most tablet 27 is dispensed from the release mechanism 40. Thus, as is shown in FIG. 5, the release button 34 has been depressed, retaining arm 42 has forced lid 30 to rotate about hinge 31, and the slide arm 41, working in conjunction with the upward movement of lid 30, forces tablet 27 to be dispensed from the tablet magazine by the slide hook 44.

As is shown in FIG. 5 and FIG. 4, beveled surface 43 works to allow the top tablet 27 to be removed readily by slide hook 44 by providing a curved or smooth surface for dispensing thereof. Once the top most tablet 27 has been released from the tablet magazine 21, the lid 30 may be closed thereby forcing the slide arm 41 and slide hook 44 in the closed position as depicted in FIG. 4. Further, the slide actuator 35 may be biased by another spring in the horizontal plane thereby forcing the slide actuator 35 in the closed and locked position once lid 30 is reclosed after dispensing of a tablet. Thus slide actuator 35 may have formed thereon a retaining notch for maintaining the slide actuator in the open position until the button 34 is depressed thereby causing the slide actuator 35 to work in conjunction with a biasing spring forcing the actuator back in the closed and locked position once the release button 34 returns to its upmost position as caused by the spring 36.

As an alternative to the release button and slide actuator depicted in FIGS. 1–5, FIG. 6 depicts an another embodiment 100 of the release mechanism wherein instead of a release button, upward force is required along thumbpad 133 in order to open lid 130. Initially however, in order to force the lid 130 in the upward and open position, the slide actuator 35 must again be activated in order to allow the support bar 138 to bypass slide actuator 35. Thus, in operation, the slide actuator 35 is placed in the open unlocked position as depicted in FIG. 5, and upward force along thumbpad 133 allows the lid 130 to rotate about hinge 131 thereby opening the dispenser. As is shown, the hinge point 131 may be constructed of a hinge bracket 132 which straddles the lid 130 and which allows rotational movement of the lid 130 thereon. A biasing spring 136 may be provided such that the lid 130 is biased to the closed position and therefore, once opened, the lid 130 will attempt to reclose and lock. The hinge bracket 132 may straddle the lid 130 on the exterior surface thereof. However, alternative hinge points may be constructed thereby allowing rotational movement of the lid 130 about any axis defined by hinge 131.

In conjunction with the lid 130 is a similar slide arm 41 which allows the dispensing of individual tablets from the tablet magazine 21 upon upward movement of the lid 130. Thus, thumbpad 133 provides a frictional contact for the user to rotate the lid 130 about hinge 131 thereby releasing the top tablet from the tablet magazine 21 through the use of slide arm 41 and slide hook 44. Such a design may be desirable when downward force is not necessarily desired and instead an upward force or sliding action would be preferred while still maintaining the multiple action requirement of a child resistant dispenser.

One skilled in the art will appreciate that the present invention can be practiced by other than the described embodiments which are presented for purposes of illustration only and not by limitation.

We claim:

1. A child resistant tablet dispenser comprising:

a body portion and a release mechanism mounted on a top open end of said body portion;

said release mechanism having a lid in movable relation with a release button;

said lid hingedly connected to a lid mount by a hinge;

said release button having a depending button support bar;

said release mechanism further having a slide actuator, said slide actuator movable from a locked position to an open position, said slide actuator in interference relationship with said button support bar when said slide actuator is in said locked position;

said release button being movably related to said lid by a retaining arm, said retaining arm causing said lid to rotate about said hinge;

a slide arm affixed to said lid and extending below said release button, said slide having a slide hook, said slide hook formed below said release button; and, said release button being downwardly movable when said slide actuator is in said open position and causing said lid to rotate about said hinge.

2. The child resistant tablet dispenser of claim 1 further comprising a biasing spring below said release button biasing said release button upward.

3. The child resistant tablet dispenser of claim 2 wherein said body portion further has a tablet magazine container therein, said tablet magazine having a plurality of tablets in stacked relation, said tablet magazine resting upon a platform.

4. The dispenser of claim 3 further comprising a biasing spring between said platform and a base of said body portion.

5. The dispenser of claim 1 further comprising a tablet magazine container within said body portion, said tablet magazine having a plurality of tablets, said slide hook contacting a top tablet.

6. The dispenser of claim 5 wherein said slide arm is slidable in a horizontal direction when said lid is opened causing said top tablet to be dispensed from said release mechanism.

7. A child resistant tablet dispenser, comprising:

a body portion and a release mechanism mounted on a top open end of said body portion;

said release mechanism having a hinged lid rotatable about a hinge and a downward extending button support bar;

said button support bar contacting a slide actuator when said actuator is in a locked position, said slide actuator movable from said locked position to an open position thereby removing said contact of said support bar with said slide actuator;

said body portion having a hollow interior containing a tablet magazine, said tablet magazine supported on a platform, said platform having a spring extending therebelow and biasing said platform in an upward direction; and, a slide arm affixed at a first end to said lid and a slide hook at an opposite distal end.

8. The child resistant tablet dispenser of claim 7 further comprising a biasing spring adjacent to said button support bar.

9. The child resistant tablet dispenser of claim 8 wherein said lid is hingedly affixed to a hinge bracket, said lid having a thumb pad on an exterior surface thereof opposite said button support bar, said lid, thumb pad and said button support bar of unitary construction.

10. The child resistant tablet dispenser of claim 9 wherein said hinge bracket is a saddle hinge bracket which extends around at least a portion of said exterior surface of said lid.

11. The child resistant tablet dispenser of claim 8 wherein said body portion has a beveled release surface on an interior wall thereof.

12. The child resistant tablet dispenser of claim 11 further comprising a release button, said release button having a top horizontal surface, said button support bar depending from said top horizontal surface.

13. The child resistant tablet dispenser of claim 12 further comprising a retaining arm, said retaining arm engaging said release button and said lid such that downward movement of said release button causes said lid to rotate about said hinge through said retaining arm.

14. The child resistant tablet dispenser of claim 12 further comprising a rigid retaining arm affixed to said lid and said release button.

15. A child resistant tablet dispenser, comprising:

a body portion and a release mechanism on a top open end of said body portion;

said release mechanism having a rotatable lid having a hinge connection to a lid mount;

a vertically movable release button and a depending support bar;

a slide actuator in interference relation with said support bar, said slide actuator movable along a horizontal plane;

a retaining arm affixed to said release button and said lid;

a slide arm affixed to and depending from said lid and having a slide hook at an opposite end; and, said support bar preventing said lid from rotating about said hinge connection unless aid slide actuator is removed from said interference relation with said support bar.

16. A child resistant tablet dispenser, comprising:

a cylindrical body portion having an open top end and a tablet magazine retained therein, said tablet magazine resting upon a platform, said platform biased by a spring against a bottom interior end of said body portion;

a release mechanism having a lid with a top wall and a hinge connection, a support bar depending from said top wall, a rotatable slide actuator below said support bar and in interference relation with said support bar, a biasing spring below said top wall and urging said lid about said hinge connection;

wherein said slide actuator has a locked position and an open position, said locked position of said slide actuator established when said actuator is in said interference relation with said support bar, said open position established when said slide actuator is not in interference relation with said support bar;

said release mechanism further having a slide arm depending from said lid and contacting a top tablet on said tablet magazine and forcing said top tablet out of said release mechanism when said lid is opened.

17. The child resistant tablet dispenser of claim 16 further comprising a release button separated from said lid, said button support bar depending from said release button, said biasing spring urging said release button in the upward direction.

18. The child resistant tablet dispenser of claim 17 further comprising a rigid retaining arm affixed to said lid and said release button.

19. A child resistant tablet dispenser, comprising:

a body portion and a release mechanism mounted on a top open end of said body portion, said release mechanism having a hinged lid rotatable about a hinge, a release button and a button support bar extending downward from said release button, said button support bar contacting an upper surface of a slide actuator when said slide actuator is in a locked position, said slide actuator movable from said locked position to an open position thereby removing said contact of said button support bar with said slide actuator, said body portion having a hollow interior containing a tablet magazine, said tablet magazine supported on a platform, said platform having a spring extending downward to a bottom end of said hollow interior of said body portion and biasing said platform in an upward direction, said release mechanism further having a retaining arm extending rearward from an interior side of said lid to said release button and pivotable about said hinge such that downward force on said release button causes said lid to rotate upward about said hinge, said hinge also having a slide arm extending downward from said interior side of said lid to a slide hook, said slide hook contacting said tablet magazine.

* * * * *